US006463227B1

(12) United States Patent
Denton et al.

(10) Patent No.: US 6,463,227 B1
(45) Date of Patent: Oct. 8, 2002

(54) COLOR ADJUSTMENT METHOD FOR A LASER PRINTER WITH MULTIPLE PRINT RESOLUTIONS

(75) Inventors: Gary Allen Denton, Lexington, KY (US); Cary Patterson Ravitz, Lexington, KY (US); Stanley Coy Tungate, Jr., Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/965,434

(22) Filed: Sep. 27, 2001

(51) Int. Cl.[7] ..... G03G 15/00
(52) U.S. Cl. ..... 399/49; 347/131; 358/406
(58) Field of Search ..... 399/46, 49; 347/129, 347/131, 132, 133, 139; 358/300, 406

(56) References Cited

U.S. PATENT DOCUMENTS

| | | | |
|---|---|---|---|
| 4,106,870 | A | 8/1978 | Kondo et al. |
| 4,647,184 | A | 3/1987 | Russell et al. |
| 4,878,082 | A | 10/1989 | Matsushita et al. |
| 5,148,217 | A | 9/1992 | Almeter et al. |
| 5,148,289 | A | 9/1992 | Nishiyama et al. |
| 5,194,945 | A | 3/1993 | Kadowaki et al. |
| 5,227,842 | A | 7/1993 | Hayashi et al. |
| 5,250,988 | A | 10/1993 | Matsuura et al. |
| 5,257,037 | A | 10/1993 | Haneda et al. |
| 5,315,351 | A | 5/1994 | Matsushiro et al. |
| 5,386,276 | A | 1/1995 | Swales et al. |
| 5,461,462 | A | 10/1995 | Nakane et al. |
| 5,486,901 | A | 1/1996 | Fukuchi et al. |
| 5,502,550 | A | 3/1996 | Hori et al. |
| 5,512,986 | A | 4/1996 | Toyomura et al. |
| 5,521,677 | A | 5/1996 | Brewington et al. |
| 5,543,896 | A | 8/1996 | Mestha |
| 5,559,579 | A | 9/1996 | Gwaltney et al. |
| 5,568,234 | A | 10/1996 | Shiba |
| 5,574,544 | A | 11/1996 | Yoshino et al. |
| 5,678,132 | A | 10/1997 | Shiba et al. |
| 5,694,223 | A | 12/1997 | Katori et al. |
| 5,710,958 | A | 1/1998 | Raj |
| 5,722,003 | A | 2/1998 | Suzuki et al. |
| 5,722,007 | A | 2/1998 | Ogata et al. |
| 5,726,779 | A | 3/1998 | Kadowaki et al. |
| 5,748,330 | A | 5/1998 | Wang et al. |
| 5,748,857 | A | 5/1998 | Nakamura et al. |
| 5,777,750 | A | 7/1998 | Takiyama et al. |
| 5,784,667 | A | 7/1998 | Mestha et al. |
| 5,797,064 | A | 8/1998 | Raj et al. |
| 5,819,132 | A | 10/1998 | Hirobe |
| 5,826,079 | A | 10/1998 | Boland et al. |
| 5,873,011 | A | 2/1999 | Takemoto et al. |

(List continued on next page.)

FOREIGN PATENT DOCUMENTS

| | | | |
|---|---|---|---|
| JP | 11-258871 A | * | 9/1999 |
| JP | 2001-147563 A | * | 5/2001 |

* cited by examiner

*Primary Examiner*—Joan Pendegrass
(74) *Attorney, Agent, or Firm*—Ronald K. Aust; Taylor & Aust P.C.

(57) ABSTRACT

An electrophotographic machine has at least two printing modes, with each printing mode having a respective printing density. A method of calibrating the electrophotographic machine includes depositing at least one toner patch on an image-bearing surface. The depositing is performed in a first of the printing modes. Light is emitted onto the at least one toner patch. An amount of light that is reflected off of the at least one toner patch is measured. At least one first electrophotographic condition for the first printing mode is adjusted dependent upon the measuring step. At least one second electrophotographic condition is adjusted for a second of the printing modes. The adjusting of the at least one second electrophotographic condition is dependent upon the measuring step.

31 Claims, 3 Drawing Sheets

U.S. PATENT DOCUMENTS 5,895,141 A 4/1999 Budnik et al.
5,903,796 A 5/1999 Budnik et al.
5,933,680 A 8/1999 Nishimura
5,937,229 A 8/1999 Walgrove et al.
5,953,554 A 9/1999 Ohnishi et al.
5,966,561 A 10/1999 Yamaguchi
5,974,276 A 10/1999 Oogi
5,987,272 A 11/1999 Maeda et al.
5,995,248 A 11/1999 Katori et al.
6,047,146 A 4/2000 Ito et al.
6,064,848 A 5/2000 Haneda
6,078,401 A 6/2000 Kanamori
6,104,891 A 8/2000 Maebashi et al.
6,124,870 A 9/2000 Morimoto

COLOR ADJUSTMENT METHOD FOR A LASER PRINTER WITH MULTIPLE PRINT RESOLUTIONS

BACKGROUND OF THE INVENTION

1. Field of the Invention

The present invention relates to multi-color electrophotographic machines, and, more particularly, to setting laser power and developer bias in multi-color electrophotographic machines.

2. Description of the Related Art

Toner patch sensors are used in color printers and copiers to monitor and control the amount of toner laid down by the electrophotographic process. Toner patch sensors reflect light off of a toner patch to determine how much toner was laid down during the electrophotographic process. The sensor's voltage signal from reading a toner patch is compared to the sensor signal from reading a bare surface to produce either a voltage difference or a ratio between the two signals.

Toner patch sensors are used in printers and copiers to monitor the toner density of unfused images and provide a means of controlling the print darkness. This information is then used to adjust laser power, developer bias, and other process conditions that affect image density. In color printers and copiers, the toner patch sensors are used to maintain the color balance and in some cases to modify the gamma correction or halftone linearization as the electrophotographic process changes with the environment and aging effects. Conventional reflection based toner sensors use a single light source to illuminate a test patch of toner and one or more photosensitive devices to detect the reflected light.

It is known to use the test images to both control solid area density and to apply a gradation correction (linearization) to the halftone printing curve. The automatic color adjustment process can be annoying to the printer user since the printer is unavailable for printing customer jobs for several minutes during this process. The test patches used in this process also consume toner, which reduces the cartridge yields and increases the need for waste toner storage.

It is known for a printer to have at least two modes of print resolution, such as 600 dots per inch (dpi) and 1200 dpi. The halftone screens used in each mode may use different dot sizes and screen angles. Because of this and the change in process speed, the gradation correction required for the 600 dpi mode halftones is different than the gradation correction needed for 1200 dpi halftones. FIG. 1 is a plot of L* (lightness) values for a range of cyan halftone values (0–255) printed in 600 dpi mode and in 1200 dpi mode. A plot such as FIG. 1 is known as the "halftone printing response curve", "halftone response curve", or "halftone printing curve". The 1200 dpi halftones print noticeably lighter than the 600 dpi halftones for halftone levels of 20–50. Experiments have shown that the 1200 dpi halftone densities cannot reliably be predicted from the 600 dpi halftones because the correlation between the two halftone series varies with laser power and developer bias.

The correlation between the two modes will also vary with the frequency response of the particular laser printheads used in a given printer. To achieve the highest possible print quality, it then becomes necessary to perform additional reflective measurements on patches in 1200 dpi mode. This additional information can then be used to perform an accurate gradation correction on the 1200 dpi halftones. Because the 1200 dpi halftones are printed at a reduced speed, the total time required and waste toner generated by this double color adjustment procedure is even more annoying to the average user.

What is needed in the art is a method of providing accurate color adjustments that minimizes the time and toner used by the color adjustment procedure when there are multiple print resolution modes.

SUMMARY OF THE INVENTION

The present invention provides a method of using a toner patch sensor to control the solid area density and provide information for linearizing the halftone response at 600 dpi. Additional patches are printed at 1200 dpi only as needed to allow the printer to correctly linearize the 1200 dpi halftone response. The 1200 dpi set points for laser power and developer bias are extrapolated from the 600 dpi set points.

The invention comprises, in one form thereof, an electrophotographic machine having at least two printing modes, with each printing mode having a respective printing density. A method of calibrating the electrophotographic machine includes depositing at least one toner patch on an image-bearing surface. The depositing is performed in a first of the printing modes. Light is emitted onto the at least one toner patch. An amount of light that is reflected off of the at least one toner patch is measured. At least one first electrophotographic condition for the first printing mode is adjusted dependent upon the measuring step. At least one second electrophotographic condition is adjusted for a second of the printing modes. The adjusting of the at least one second electrophotographic condition is dependent upon the measuring step.

The invention comprises, in another form thereof, a method of calibrating an electrophotographic machine having at least two printing modes. Each printing mode has a respective printing density. The method includes depositing at least one solid area toner patch on an image-bearing surface. The depositing is performed in a first of the printing modes. Light is emitted onto the at least one solid area toner patch. An amount of light that is reflected off of the at least one solid area toner patch is measured. At least one first electrophotographic condition for printing in the first printing mode at full density is adjusted dependent upon the measuring step. At least one first halftone patch is deposited on the image-bearing surface. The depositing is performed in the first printing mode and is dependent upon the at least one first electrophotographic condition. Light is emitted onto the at least one first halftone patch. An amount of light that is reflected off of the at least one first halftone patch is measured. A correction curve of gradation for printing in the first printing mode at less than full density is formed dependent upon the measured amount of light that is reflected off of the at least one first halftone patch. At least one second electrophotographic condition for printing in a second of the printing modes at full density is adjusted dependent upon the measured amount of light that is reflected off of the at least one solid area toner patch. At least one second halftone patch is deposited on the image-bearing surface. The depositing is performed in the second printing mode and is dependent upon the at least one second electrophotographic condition. Light is emitted onto the at least one second halftone patch. An amount of light that is reflected off of the at least one second halftone patch is measured. A correction curve of gradation for printing in the second printing mode at less than full density is formed dependent upon the measured amount of light that is reflected off of the at least one second halftone patch.

An advantage of the present invention is that color adjustments for two different printing modes can be made by printing toner test patches in only one of the two modes.

Another advantage is that a minimal amount of time is required to perform color adjustment for two different printing modes.

Yet another advantage is that a minimal amount of toner is required to perform color adjustment for two different printing modes.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
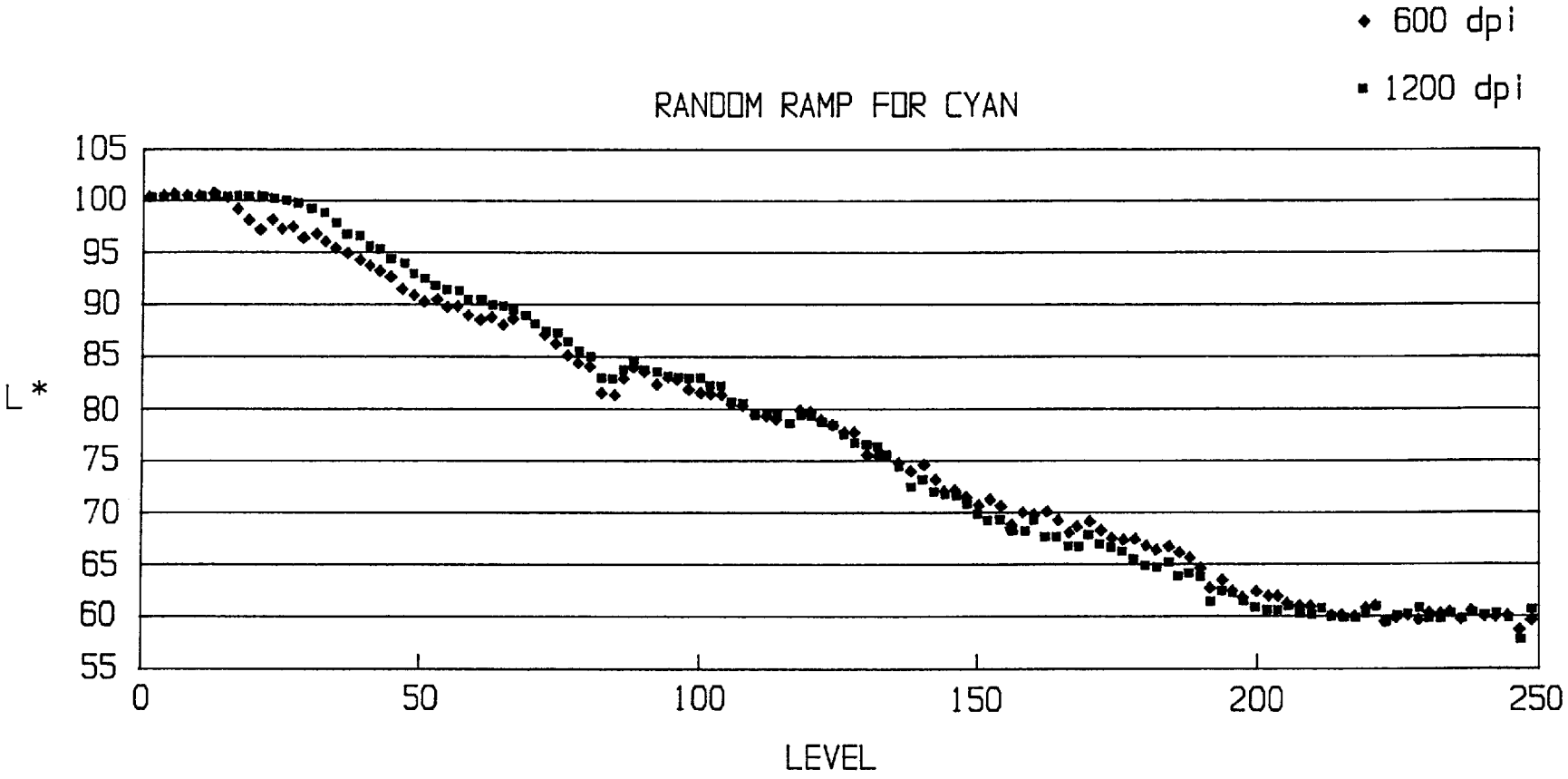
FIG. 1 is a plot of L* (lightness) values for a range of halftone values (0–255) printed in 600 dpi mode and in 1200 dpi mode.

One embodiment of a multicolor laser printer 10 (FIG. 2) that can be used in conjunction with the method of the present invention includes laser printheads 12, 14, 16, 18, a black toner cartridge 20, a magenta toner cartridge 22, a cyan toner cartridge 24, a yellow toner cartridge 26, photoconductive drums 28, 30, 32, 34, and an intermediate transfer member belt 36.

Figure 2:
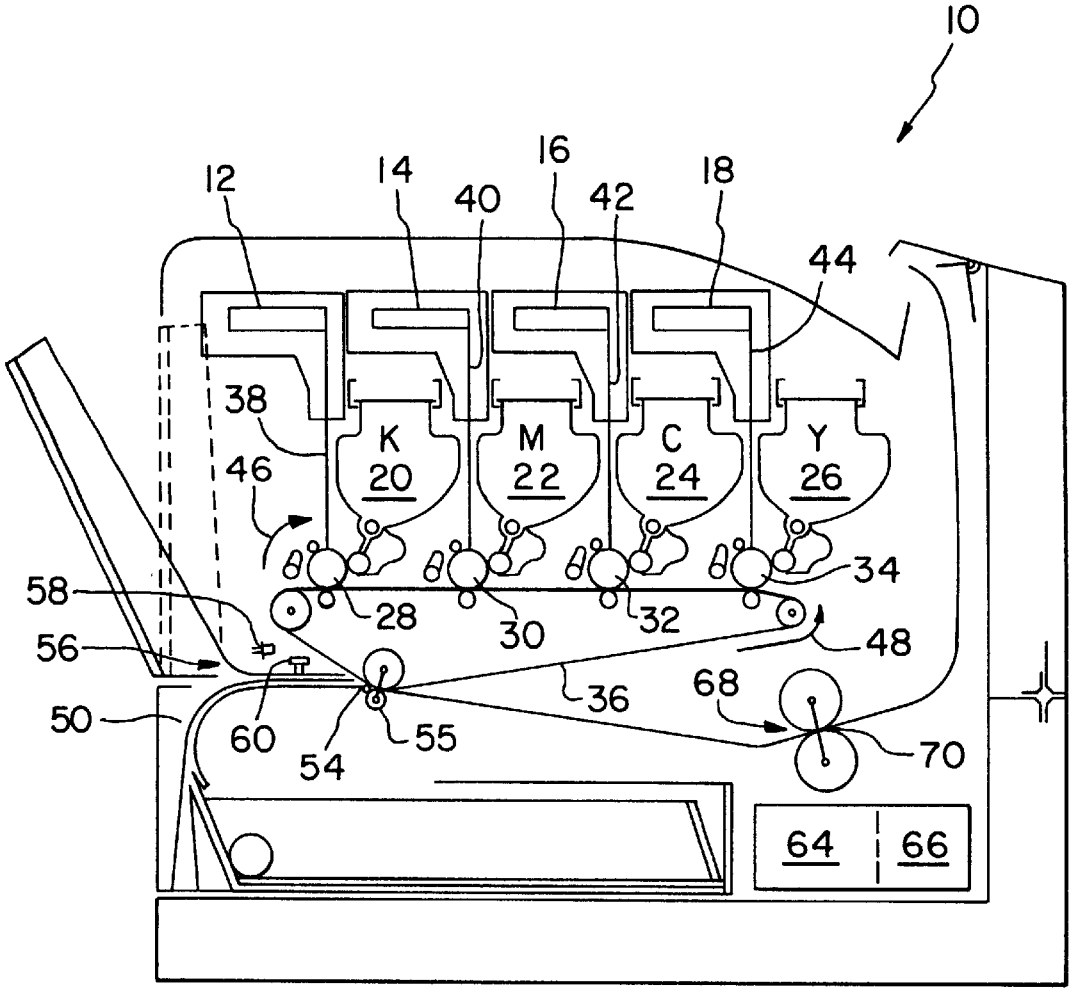
FIG. 2 is a side sectional view of a multicolor laser printer which can be used in conjunction with the method of the present invention.

Each of laser printheads 12, 14, 16 and 18 scans a respective laser beam 38, 40, 42, 44 in a scan direction, perpendicular to the plane of FIG. 2, across a respective one of photoconductive drums 28, 30, 32 and 34. Each of photoconductive drums 28, 30, 32 and 34 is negatively charged to approximately −900 volts and is subsequently discharged to a level of approximately −200 volts in the areas of its peripheral surface that are impinged by a respective one of laser beams 38, 40, 42 and 44 to form a latent image thereon made up of a plurality of dots, or pels. The photoconductive drum discharge is limited to about −200 volts because the conductive core is biased at −200 volts to repel toner at the beginning of printing when the photoconductive surface touching the developer roll has not yet been charged to −900 volts by the charge roll. During each scan of a laser beam across a photoconductive drum, each of photoconductive drums 28, 30, 32 and 34 is continuously rotated, clockwise in the embodiment shown, in a process direction indicated by direction arrow 46. The scanning of laser beams 38, 40, 42 and 44 across the peripheral surfaces of the photoconductive drums is cyclically repeated, thereby discharging the areas of the peripheral surfaces on which the laser beams impinge.

The toner in each of toner cartridges 20, 22, 24 and 26 is negatively charged to approximately −600 volts. A thin layer of negatively charged toner is formed on the developer roll by means known to those skilled in the art. The developer roll is biased to approximately −600 volts. Thus, when the toner from cartridges 20, 22, 24 and 26 is brought into contact with a respective one of photoconductive drums 28, 30, 32 and 34, the toner is attracted to and adheres to the portions of the peripheral surfaces of the drums that have been discharged to −200 volts by the laser beams. As belt 36 rotates in the direction indicated by arrow 48, the toner from each of drums 28, 30, 32 and 34 is transferred to the outside surface of belt 36. As a print medium, such as paper, travels along path 50, the toner is transferred to the surface of the print medium in nip 54. Transfer to paper is accomplished by using a positively biased transfer roll 55 below the paper in nip 54.

Figure 3:
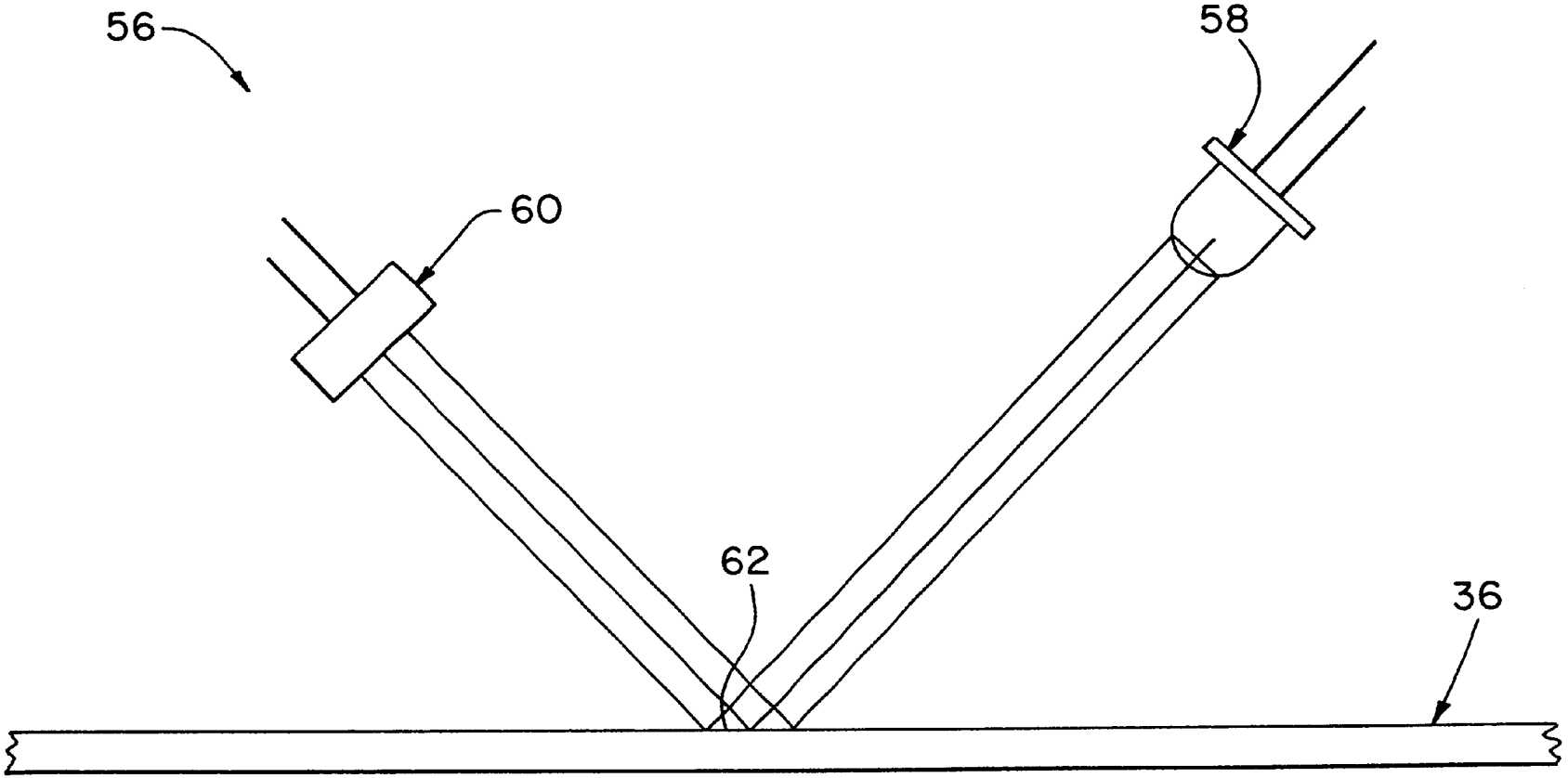
FIG. 3 is a schematic side view of the sensor arrangement of FIG. 1.

A sensor arrangement 56 includes a light source 58 and a light detector 60. Since belts are prone to warp and flutter as they move between rollers, sensor arrangement 56 can be located opposite a roller to stabilize the distance between sensor arrangement 56 and belt 36. Light source 58 illuminates a toner test patch 62 (FIG. 3) on intermediate belt 36. The light reflecting off of toner patch 62 is sensed by light detector 60.

Test patch 62 is formed by depositing a solid area patch of black, cyan, magenta, or yellow toner on intermediate belt 36. Cyan, magenta, and yellow toners are all fairly reflective powders at 880 nm, the wavelength used by toner patch sensor arrangement 56. Toner patch 62 is formed using near maximum laser power and developer bias settings so as to produce substantial toner densities on the magenta, cyan or yellow photoconductive drum. When patch 62 to be read by patch sensor 56 is formed of cyan, magenta, or yellow toner, the gain setting of toner patch sensor 56 is reduced by a factor of eight from its black toner gain setting to avoid clipping. Otherwise, the signal level might exceed the dynamic range of the patch sensor circuitry. An engine controller 64 records and processes readings from sensor arrangement 56.

Since the primary usage of printer 10 tends to be in 600 dpi mode, the 1200 dpi color adjustment measurements may not be required for most customer jobs. These measurements can be put off until they are actually required, i.e., when printer 10 has received a 1200 dpi job. In another embodiment, the 1200 dpi halftone patches are sampled immediately after the 600 dpi halftone samples. This avoids the need for a second "mini-calibration."

The color adjustment procedure is divided into two parts as follows. In the first part, toner patch sensor 56 is used to monitor the image density of unfused solid area test patches on an image-bearing surface, such as intermediate belt 36 or a photoconductor. These solid area test patches are formed in the 600 dpi print mode. Information from these solid area patches is used to adjust electrophotographic conditions for printing in the 600 dpi mode at full density. The electrophotographic conditions can include the laser power, the charge voltage applied to photoconductive drums 28, 30, 32, 34, and the developer bias for each color. After the electrophotographic process conditions for full density have been set, a series of halftone test patches are sensed by toner patch sensor 56 to form a gradation curve of correction for the 600 dpi halftones of each color. That is, the amounts of toner required to be deposited on belt 36 to achieve various halftone density levels (i.e., levels at less than full density) for each color at 600 dpi are determined. This completes the first part of the calibration procedure. If there is no immediate need for 1200 dpi color adjustment information, printer 10 resumes processing and printing customer jobs.

When a new customer job is received that will require printer 10 to switch to the 1200 dpi mode, the laser power and developer bias settings required for printing at 1200 dpi at full density are extrapolated or otherwise calculated from the laser power and developer bias settings required for printing at 600 dpi at full density. For example, the laser power setting needed for the 1200 dpi full density printing mode, $LPOW_{1200}$, may be linearly related to the laser power setting needed for the 600 dpi full density printing mode, $LPOW_{600}$, by the equation $$LPOW_{1200}=a1*LPOW_{600}+a2,$$

where a1 and a2 are empirically determined constants.

The developer bias voltage may be determined in a similar manner. For example, the developer bias voltage setting needed for the full density 1200 dpi printing mode, $DevBias_{1200}$, may be linearly related to the developer bias voltage setting needed for the full density 600 dpi printing mode, $DevBias_{600}$, by the equation $$DevBias_{1200}=b1*DevBias_{600}+b2,$$

where b1 and b2 are empirically determined constants.

The 1200 dpi full density electrophotographic condition values are recorded in non-volatile memory 66 for future use. The test patches needed to characterize the 1200 dpi halftone response curve are then printed onto intermediate belt 36 and read by toner patch sensor 56. The patch sensor data, i.e., the amount of light reflected off of the halftone test patches, is converted into anticipated L* or b* values for each of the test patches and this information is used to form the gradation curve of correction at 1200 dpi for each color. That is, the amounts of toner required to be deposited on belt 36 to achieve various halftone density levels (i.e., levels at less than full density) for each color at 1200 dpi are determined. When color laser printers change print modes from 600 dpi, which may print at twenty pages per minute, to 1200 dpi, which may print at ten pages per minute, the temperature of fuser 68 has to be reduced to avoid hot offset because of the longer dwell time in fuser nip 70. Thus, a cool down time period is provided for fuser 68. The additional halftone patches needed for the 1200 dpi gradation correction can be printed during this cooling time in order to partially or completely conceal the "downtime" from the user.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of calibrating an electrophotographic machine having at least two printing modes, each said printing mode having a respective printing density, said method comprising the steps of:

depositing at least one solid area toner patch on an image-bearing surface, said depositing being performed in a first of the printing modes;

emitting light onto said at least one solid area toner patch;

measuring an amount of light that is reflected off of said at least one solid area toner patch;

adjusting at least one first electrophotographic condition for printing in the first printing mode at full density, said adjusting being dependent upon said measuring step;

depositing at least one first halftone patch on the image-bearing surface, said depositing being performed in the first printing mode and being dependent upon said at least one first electrophotographic condition;

emitting light onto said at least one first halftone patch;

measuring an amount of light that is reflected off of said at least one first halftone patch;

forming a correction curve of gradation for printing in the first printing mode at less than full density, said forming being dependent upon said measured amount of light that is reflected off of said at least one first halftone patch;

adjusting at least one second electrophotographic condition for printing in a second of the printing modes at full density, said adjusting being dependent upon said measured amount of light that is reflected off of said at least one solid area toner patch;

depositing at least one second halftone patch on the image-bearing surface, said depositing being performed in the second printing mode and being dependent upon said at least one second electrophotographic condition;

emitting light onto said at least one second halftone patch;

measuring an amount of light that is reflected off of said at least one second halftone patch; and forming a correction curve of gradation for printing in the second printing mode at less than full density, said forming being dependent upon said measured amount of light that is reflected off of said at least one second halftone patch.

2. The method of claim 1, wherein the printing density of the second printing mode is greater than the printing density of the first printing mode.

3. The method of claim 1, wherein the printing density of the first printing mode is 600 dots per inch and the printing density of the second printing mode is 1200 dots per inch.

4. The method of claim 1, wherein the image-bearing surface comprises an intermediate transfer member.

5. The method of claim 1, wherein said at least one first electrophotographic condition for printing in the first printing mode at full density comprises at least one of laser power, charge voltage applied to a photoconductive drum, and developer bias.

6. The method of claim 1, wherein said forming step for printing in the first printing mode at less than full density comprises determining a desired amount of toner to be deposited on the image-bearing surface.

7. The method of claim 1, wherein said at least one second electrophotographic condition for printing in the second printing mode at fill density comprises at least one of laser power and developer bias.

8. The method of claim 1, comprising the further step of recording said at least one second electrophotographic condition for printing in the second printing mode at full density in a non-volatile memory.

9. The method of claim 1, comprising the further step of calculating said at least one second electrophotographic condition for printing in the second printing mode at fall density from said at least one first electrophotographic condition for printing in the first printing mode at full density.

10. The method of claim 1, wherein said forming step for printing in the second printing mode at less than full density comprises determining a desired amount of toner to be deposited on the image-bearing surface.

11. The method of claim 1, comprising the further step of converting the measured light that is reflected off of said at least one second halftone patch into at least one of anticipated L* values and anticipated b* values for each said second halftone patch.

12. The method of claim 1, wherein said step of depositing at least one second halftone patch is performed during a down time of a fuser.

13. A method of calibrating an electrophotographic machine having at least two printing modes, each said printing mode having a respective printing density, said method comprising the steps of:

depositing at least one toner patch on an image-bearing surface, said depositing being performed in a first of the printing modes;

emitting light onto said at least one toner patch;

measuring an amount of light that is reflected off of said at least one toner patch;

adjusting at least one first electrophotographic condition for the first printing mode, said adjusting being dependent upon said measuring step; and adjusting at least one second electrophotographic condition for a second of the printing modes, said adjusting being dependent upon said measuring step.

14. The method of claim 13, wherein the printing density of the second printing mode is greater than the printing density of the first printing mode.

15. The method of claim 13, wherein the printing density of the first printing mode is 600 dots per inch and the printing density of the second printing mode is 1200 dots per inch.

16. The method of claim 13, wherein the image-bearing surface comprises an intermediate transfer member.

17. The method of claim 13, wherein said at least one first electrophotographic condition for the first printing mode comprises at least one of laser power, charge voltage applied to a photoconductive drum, and developer bias.

18. The method of claim 13, wherein said at least one second electrophotographic condition for the second printing mode comprises at least one of laser power, charge voltage applied to a photoconductive drum, and developer bias.

19. The method of claim 13, comprising the further step of recording said at least one second electrophotographic condition for printing in the second printing mode in a non-volatile memory.

20. The method of claim 13, comprising the further step of calculating said at least one second electrophotographic condition for printing in the second printing mode from said at least one first electrophotographic condition for printing in the first printing mode.

21. A method of calibrating an electrophotographic machine having at least two printing modes, each said printing mode having a respective printing density, said method comprising the steps of:

depositing at least one first toner patch on an image-bearing surface, said depositing being performed in a first of the printing modes;

emitting light onto said at least one first toner patch;

measuring an amount of light that is reflected off of said at least one first toner patch;

adjusting at least one first electrophotographic condition for the first printing mode, said adjusting being dependent upon said measuring step;

adjusting at least one second electrophotographic condition for printing in a second of the printing modes at full density, said adjusting being dependent upon said measuring step;

depositing at least one second toner patch on the image-bearing surface, said depositing being performed in the second printing mode and being dependent upon said at least one second electrophotographic condition;

emitting light onto said at least one second toner patch;

measuring an amount of light that is reflected off of said at least one second toner patch; and forming a correction curve of gradation for printing in the second printing mode at less than full density, said forming being dependent upon said measured amount of light that is reflected off of said at least one second toner patch.

22. The method of claim 21, wherein the printing density of the second printing mode is greater than the printing density of the first printing mode.

23. The method of claim 21, wherein the printing density of the first printing mode is 600 dots per inch and the printing density of the second printing mode is 1200 dots per inch.

24. The method of claim 21, wherein the image-bearing surface comprises an intermediate transfer member.

25. The method of claim 21, wherein said at least one first electrophotographic condition for printing in the first printing mode comprises at least one of laser power, charge voltage applied to a photoconductive drum, and developer bias.

26. The method of claim 21, wherein said at least one second electrophotographic condition for printing in the second printing mode at full density comprises at least one of laser power and developer bias.

27. The method of claim 21, comprising the further step of recording said at least one second electrophotographic condition for printing in the second printing mode at full density in a non-volatile memory.

28. The method of claim 21, comprising the further step of calculating said at least one second electrophotographic condition for printing in the second printing mode at full density from said at least one first electrophotographic condition for printing in the first printing mode.

29. The method of claim 21, wherein said forming step for printing in the second printing mode at less than full density comprises determining a desired amount of toner to be deposited on the image-bearing surface.

30. The method of claim 21, comprising the further step of converting the measured light that is reflected off of said at least one second toner patch into at least one of anticipated L* values and anticipated b* values for each said second toner patch.

31. The method of claim 21, wherein said step of depositing at least one second toner patch is performed during a down time of a fuser.

* * * * *